US008076598B2

(12) United States Patent
Billard et al.

(10) Patent No.: US 8,076,598 B2
(45) Date of Patent: Dec. 13, 2011

(54) INTERLOCK SYSTEM AND METHOD FOR ROTARY DISCONNECT SWITCHES

(75) Inventors: Justin Thomas Billard, Amston, CT (US); Dean Arthur Robarge, Southington, CT (US); Robert Joseph Caggiano, Wolcott, CT (US)

(73) Assignee: General Electric Company, Schenectady, NY (US)

( * ) Notice: Subject to any disclaimer, the term of this patent is extended or adjusted under 35 U.S.C. 154(b) by 524 days.

(21) Appl. No.: 12/211,491

(22) Filed: Sep. 16, 2008

(65) Prior Publication Data

US 2010/0065406 A1 Mar. 18, 2010

(51) Int. Cl.
*H01H 9/20* (2006.01)

(52) U.S. Cl. ..... 200/50.06

(58) Field of Classification Search ..... 200/50.02, 200/50.03, 50.05, 50.06, 50.1–50.12, 566, 200/565

See application file for complete search history.

(56) References Cited

U.S. PATENT DOCUMENTS

| | | | | |
|---|---|---|---|---|
| 3,009,029 | A * | 11/1961 | Bodenschatz et al. | 200/50.06 |
| 3,086,092 | A * | 4/1963 | Poulton, Jr. | 200/50.06 |
| 3,970,808 | A | 7/1976 | Gryctko et al. | |
| 4,118,607 | A | 10/1978 | Shaffer | |
| 4,405,844 | A | 9/1983 | Dizon et al. | |
| 4,602,136 | A * | 7/1986 | Deneke et al. | 200/50.06 |
| 4,806,710 | A | 2/1989 | Kalvaitis et al. | |
| 7,420,133 | B2 * | 9/2008 | Farrow et al. | 200/50.12 |
| 2007/0029178 | A1 | 2/2007 | Mukharzi et al. | |

* cited by examiner

*Primary Examiner* — Felix O Figueroa
(74) *Attorney, Agent, or Firm* — Cantor Colburn LLP

(57) ABSTRACT

Disclosed herein is an interlock system in combination with an enclosure, including: the enclosure having a base and a door that define an interior; a rotary handle attached to the door; a disconnect switch disposed in the interior of the enclosure and including a shaft extending toward an exterior of the enclosure in a direction toward the door; a first interlocking member attached to the door and extending toward an interior of the enclosure; and a second interlocking member attached to the shaft. The handle is configured to engage the shaft when the door is closed and rotate the shaft to move the disconnect switch between an on position and an off position. The second interlocking member is configured to engage and interlock with the first interlocking member when the door is closed and the disconnect switch is in the on position.

10 Claims, 16 Drawing Sheets

INTERLOCK SYSTEM AND METHOD FOR ROTARY DISCONNECT SWITCHES

BACKGROUND OF THE INVENTION

The subject matter disclosed herein relates to electrical equipment and, more particularly, to interlock systems for electrical enclosures.

Conventional electrical distribution equipment such as circuit breakers are encased on housings to protect the equipment and avoid contact with the equipment when operating. Interlock devices are generally utilized to prevent undesired states of the enclosure, such as the opening of the enclosure when it is connected to an electrical source. Such devices are useful in preventing inadvertent opening, and for protecting users from gaining access unless the electrical power is disconnected. The industry may, therefore, be desirous of an improved system to interlock an electrical enclosure to prevent undesirable states of the enclosure.

BRIEF DESCRIPTION OF THE INVENTION

Disclosed herein is an interlock system in combination with an enclosure. The combination includes: an enclosure having a base and a door that define an interior, the door having an open position and a closed position; a rotary handle attached to the door of the enclosure; a disconnect switch disposed in the interior of the enclosure; a first interlocking member attached to the door and extending toward an interior of the enclosure; and a second interlocking member attached to the shaft. The disconnect switch includes a shaft extending toward an exterior of the enclosure in a direction toward the door, and the handle is configured to engage the shaft when the door is in the closed position and rotate the shaft to move the disconnect switch between an on position and an off position. The second interlocking member is configured to engage and interlock with the first interlocking member when the door is in the closed position and the disconnect switch is in the on position.

Further disclosed herein is a method of controlling a position of an enclosure. The method includes: attaching a rotary handle on a door of the enclosure; disposing a disconnect switch in an interior of the enclosure; attaching a first interlocking member extending toward an interior of the enclosure to the door; attaching a second interlocking member attached to the shaft; and moving the disconnect switch between the on position and the off position. The method also includes, responsive to the disconnect switch being in the on position, engaging the first interlocking member with the second interlocking member to i) prevent the door from being moved from the closed position toward the open position and ii) allow the door to be moved from the open position toward the closed position. The method further includes, responsive to the disconnect switch being in the off position, engaging the first interlocking member with the second interlocking member to allow the door to be moved between the open position and the closed position. The disconnect switch includes a shaft extending toward an exterior of the enclosure and the handle is configured to engage the shaft when the door is in the closed position and rotate the shaft to move the disconnect switch between an on position and an off position.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
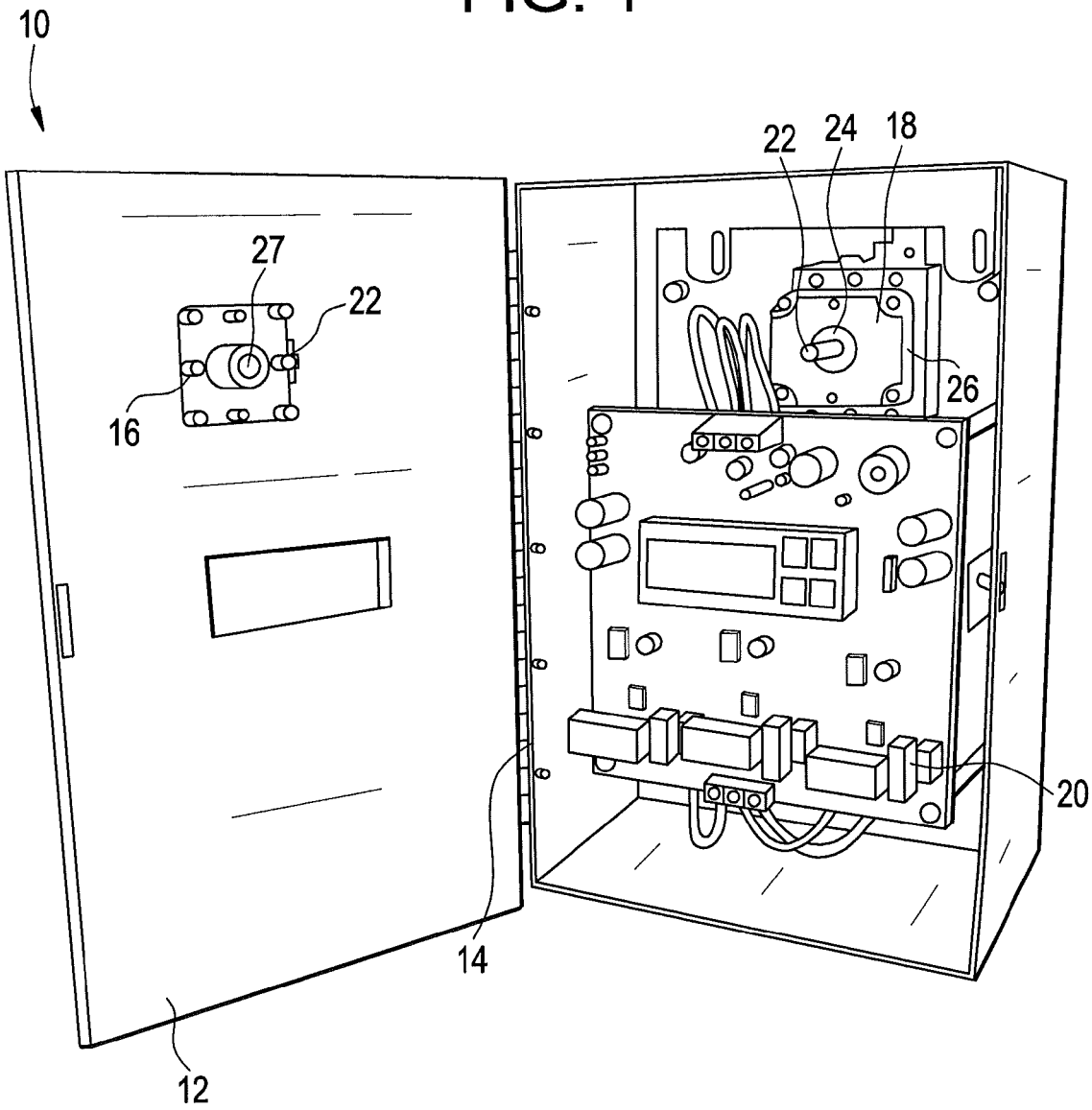
FIG. 1 depicts a perspective view of an enclosure including an interlock assembly in an open position, in accordance with an embodiment of the invention.
Figure 2:
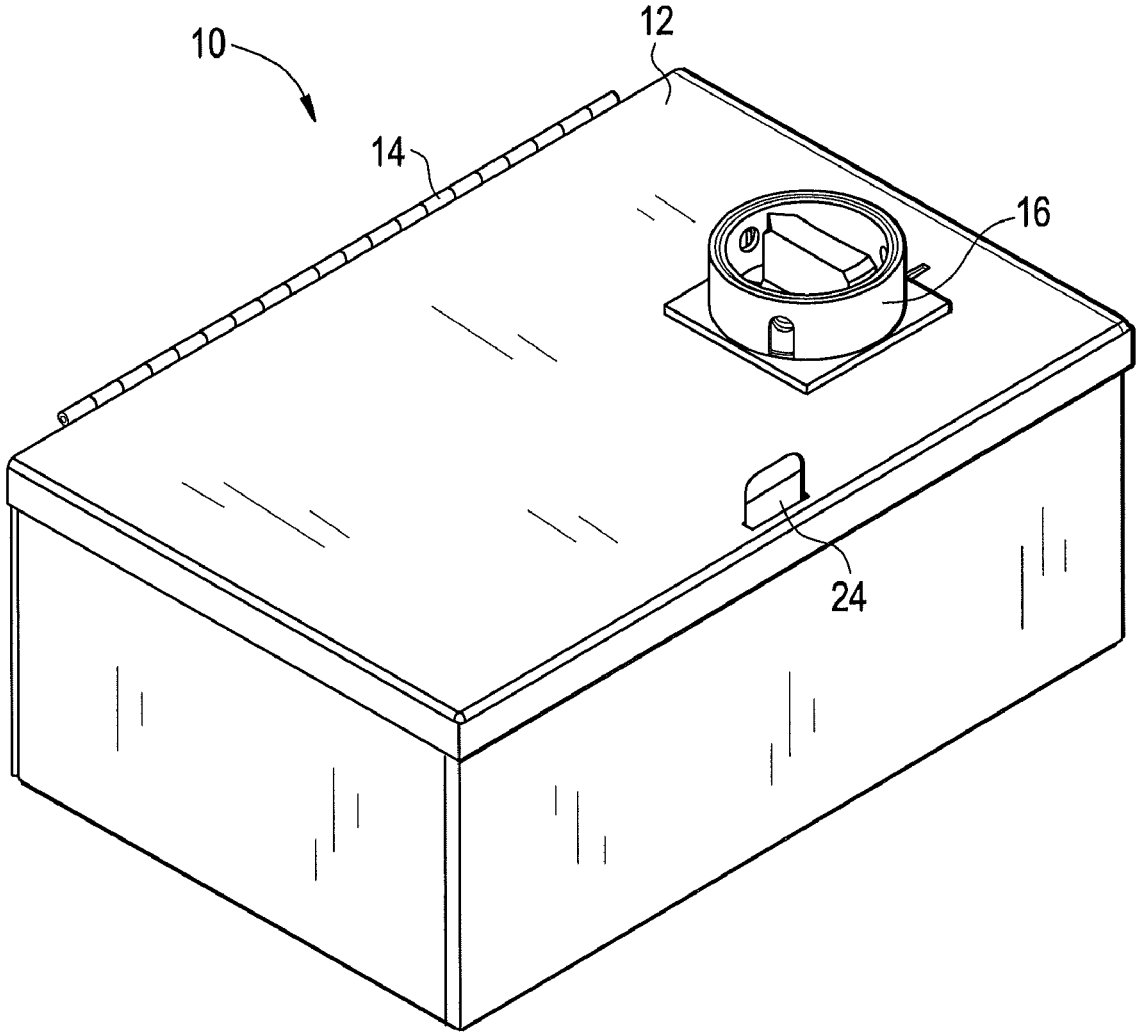
FIG. 2 depicts a perspective view of the enclosure of FIG. 1 in a closed position including a rotary handle in an off position.

Referring to FIGS. 1 and 2, an electrical enclosure 10 including an embodiment of an interlock system disclosed herein is illustrated. The enclosure 10 includes a door 12 connected to a hinge 14, a rotary handle 16 mounted on the door 12, a rotary style disconnect switch 18 mounted on an interior surface of the enclosure 10, and one or more electrical or mechanical devices 20, such as a circuit breaker. An interlock assembly 22 is included and has components attached to the handle 16 and the switch 18. Although the interlock assembly 22 is described in conjunction with the electrical enclosure 10, the interlock assembly may be utilized with any enclosure having a hinged door and a rotary style switch.

The disconnect switch 18 includes an elongated member such as a shaft 24 that extends from a switch body 26 toward the door 12. When the door 12 is closed, a recess 27 in the handle 16 engages the shaft 24, allowing the shaft 24 to be rotated about its major axis between the on and off positions. In one embodiment, the shaft 24 is a contoured shaft and the recess 27 includes a female orifice that is configured to accept the contoured shaft 24.

The interlock assembly is configured to allow the enclosure 10 to be opened and closed when the electrical disconnect switch 18 is in an "off" position. The interlock assembly is also configured so that the enclosure 10 can be closed when the electrical disconnect switch is in an "on" position, but the enclosure 10 cannot be opened unless a user takes specific action to defeat the interlock assembly 22. FIG. 2 demonstrates the off position. As referred to herein, the "off" position is a position of the handle 16 and the disconnect switch 18 in which electrical contacts of the device 20 are disengaged and no electrical power is being supplied to the device 20. In this position, the interlock assembly 22 is not engaged, thus allowing the door 12 to be readily opened, for example, by defeating a door interlock 24.

As referred to herein, the "on" position is a position in which the handle 16 is rotated away from the off position. For example, the handle 16 is turned 90 degrees in a clockwise motion to switch the handle 16 to the "on" position. In this position, the disconnect switch is in a position such that the electrical contacts are engaged, and the interlock assembly is also engaged to prevent the door 12 from being opened.

Figure 3:
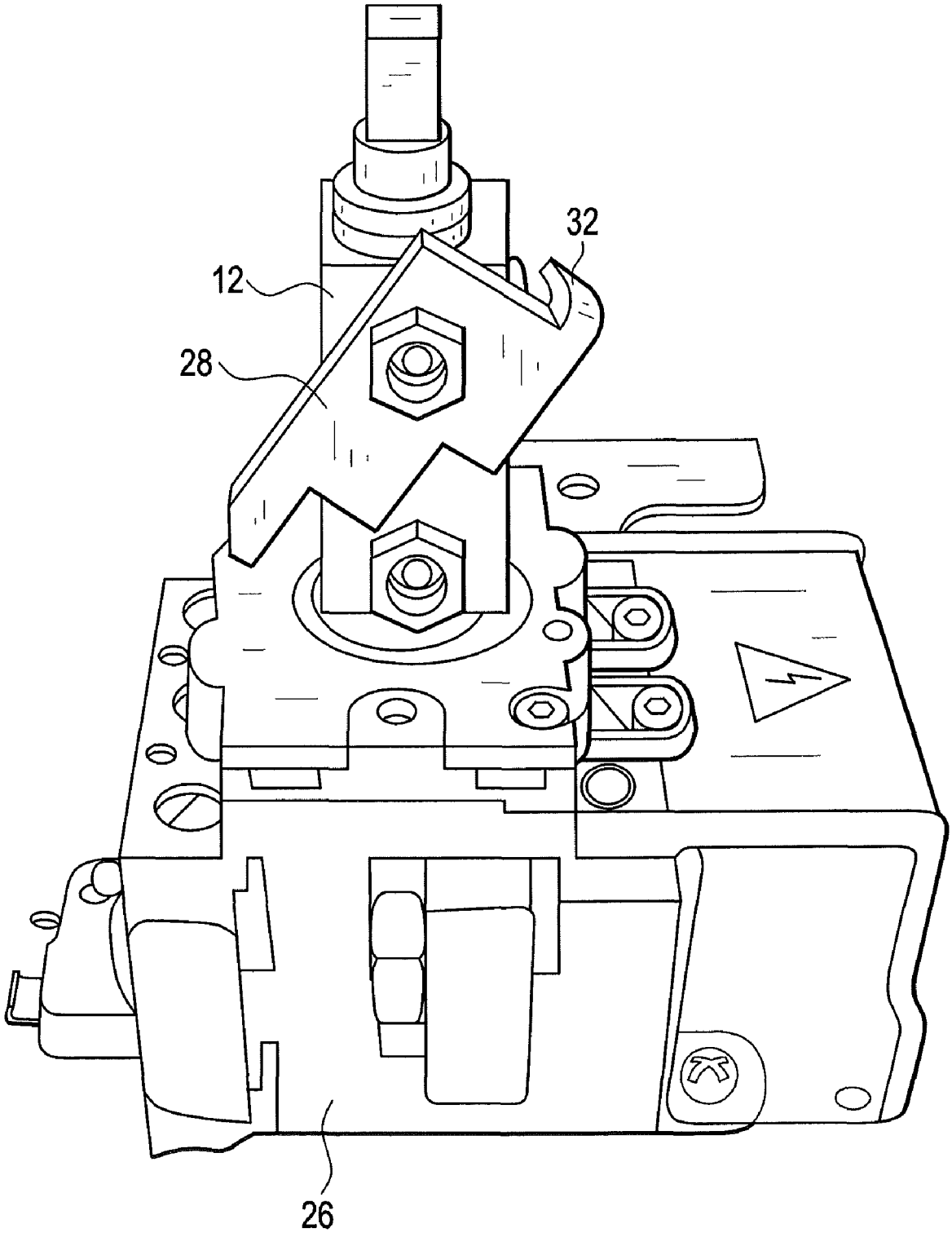
FIG. 3 depicts a perspective view of an embodiment of the disconnect switch of FIG. 1.

Referring to FIG. 3, an embodiment of the disconnect switch 18 includes the switch body 26, the shaft 24 and an interlocking member 28 attached to the shaft 24. The interlocking member is configured to engage another interlocking member 30 that is attached to the handle 16. The interlocking members 28, 30 are configured so that they are not engaged when the handle 16 is in the off position, but are engaged when the handle 16 is in the on position. In the on position, the interlocking members 28, 30 are configured to allow the door to be moved in only one direction, that is from an open position toward a closed position.

In the off position, the interlocking member 28 is disposed at a location away from a path of movement of the interlocking member 30 when the door 12 is moved between the open and closed positions. That is, the interlocking member 28 is disposed a defined distance from the interlocking member 30 sufficient so that the interlocking members 28, 30 do not contact one another when the door 12 is opened or closed.

In the on position, the interlocking member 28 is disposed at a location that intersects a path of movement of the interlocking member 30 when the door 12 is moved between the open and closed positions. That is, the interlocking member 28 is disposed so that the interlocking members 28, 30 come in contact with one another when the door 12 is opened or closed.

In one embodiment, the interlocking member is a "C-shaped" bracket having a first portion attached to the door 12, a second portion extending away from the door 12, and a third portion extending in a direction generally parallel to a plane defined by an interior surface of the door 12. If the disconnect switch is on, as the door is open or closed, the C-shaped bracket 30 that is attached to the inside of the door interferes with the interlocking member 28 attached to the shaft 24. The C-shaped bracket 30 and the door also have an access hole through them allowing the interlock to be defeated. The interlocking member 28 is configured so that interference due to the interlocking member 28 intersecting a path of the bracket 30 as the door is being opened cannot be overcome, but the interference as the door is being closed can be overcome. This ensures that the door 12 can only be closed when the switch assembly 22 is in the on position but cannot be opened. If the switch assembly 22 is off, no interference occurs, and the door 12 can be opened or closed.

In one embodiment, the interlocking member 28 is a rotating cantilever beam 28 rotatably attached to the shaft 24. The beam 28 is attached to the shaft 24 so that the beam 28 can rotate about an axis that is orthogonal to the shaft axis of rotation. The beam 28 includes a mechanical stop 32 to prevent rotation of the beam 28 away from the switch body 26 and toward the door 12. In this embodiment, the interlocking member 30 is a bracket that is fixedly attached to the door 12 and/or the handle 16. The beam 28 is allowed to fall due to gravity to a default position when the shaft 24 is in the on position, in which the beam 28 is located in a path of movement of the bracket 30.

FIG. 3 shows the interlocking member 28 in a disengaged position in which the interlocking member 28 is rotated away from the default position. In this embodiment, the interlocking member is shown being biased toward the default position by gravity. In other embodiments, the interlocking member 28 is attached to a biasing member such as a spring that holds the interlocking member 28 in tension toward the default position.

Figure 4:
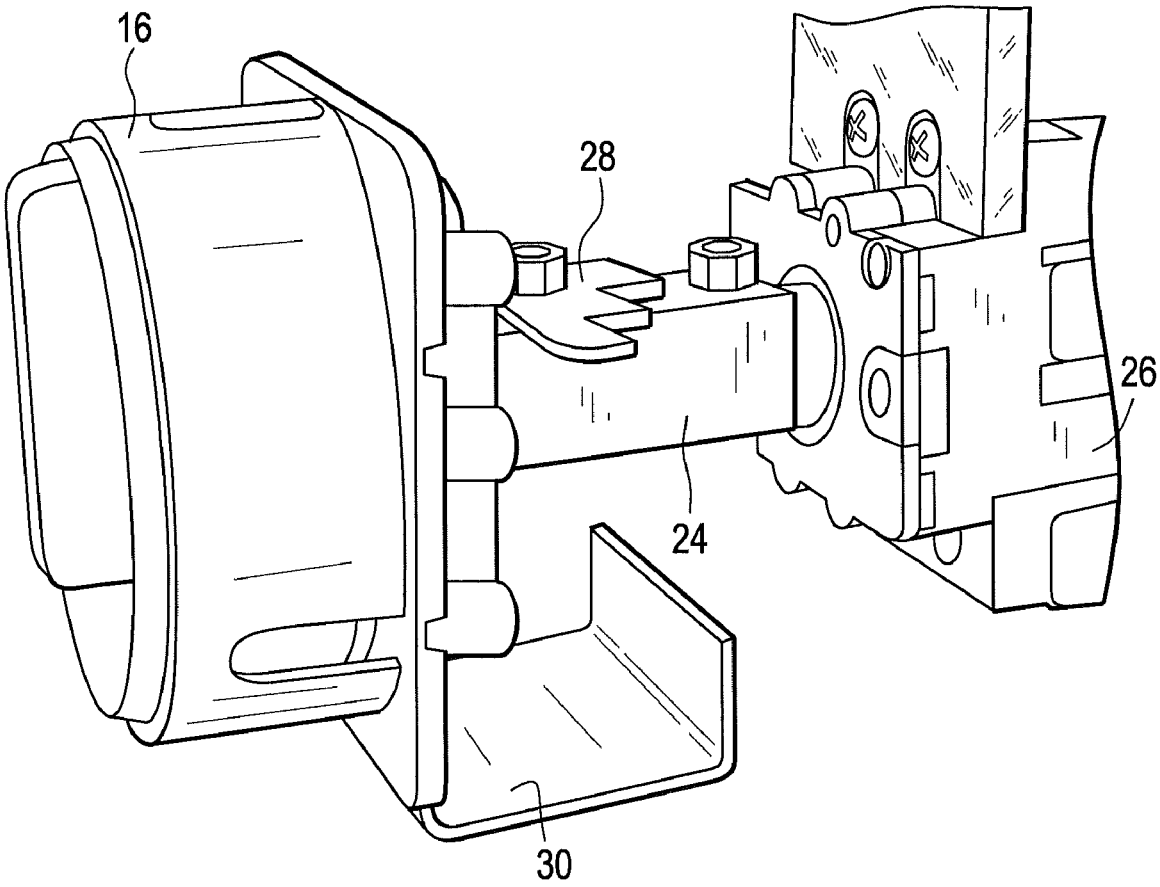
FIG. 4 depicts a perspective view of the disconnect switch of FIG. 3 with the housing removed and in an off position.

Referring to FIG. 4, the interlock assembly is shown in the off position. In this position, the beam 28 is located at a position where it would not engage the bracket 30 regardless of the position of the door 12.

Figure 5:
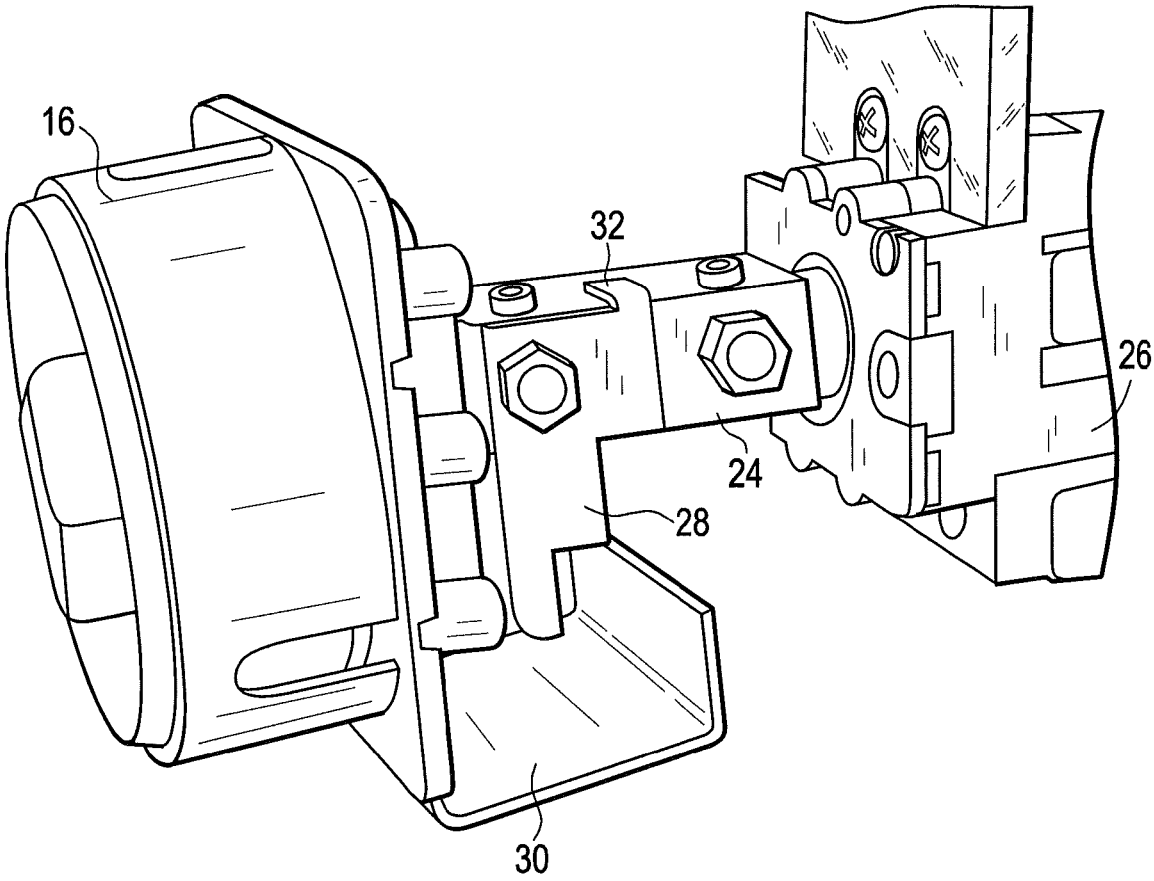
FIG. 5 depicts a perspective view of the disconnect switch of FIG. 3 with the housing removed and in an on position.

Referring to FIG. 5, in the on position, the beam 28 is rotated about the shaft axis so that the shaft 28 contacts the bracket 30 when the door 12 is moved between the open and closed positions. In this position, the beam 28 is configured to allow the door 12 to be closed but prevents the door from being moved from the closed to open position. A distance "d" is determined between a latch surface of the interlocking member 28 and the locking surface of the C-shaped bracket 30. The distance "d" is great enough to allow the interlock assembly 22 to be defeated yet still not allow the door 12 to be opened enough to allow access to live electrical components.

Figure 6:
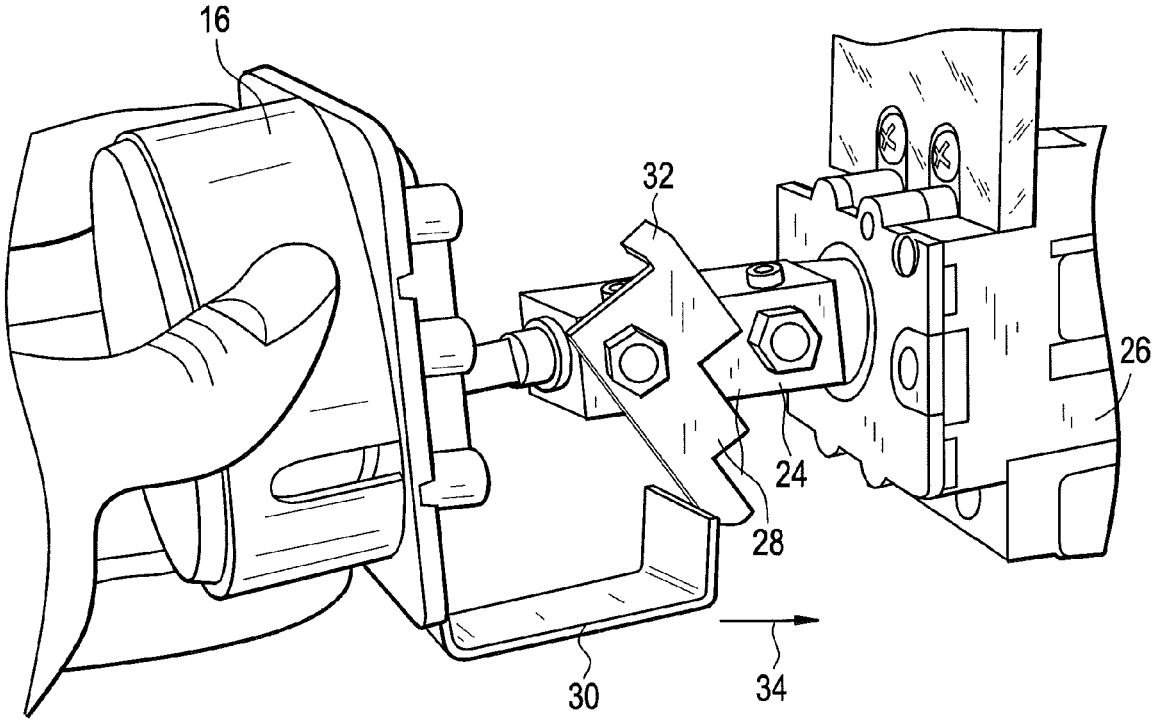
FIG. 6 depicts a perspective view of the disconnect switch of FIG. 5 with the housing removed and moving toward a closed position.

Referring to FIG. 6, in the instance that the interlock assembly 22 is in the on position, and the door 12 is moved in a direction 34 toward the closed position, the bracket 30 contacts the beam 28 and causes the beam 28 to rotate about the orthogonal axis. In this manner, the beam 28 allows the bracket 30 and the door 12 to be moved to the closed position.

Figure 7:
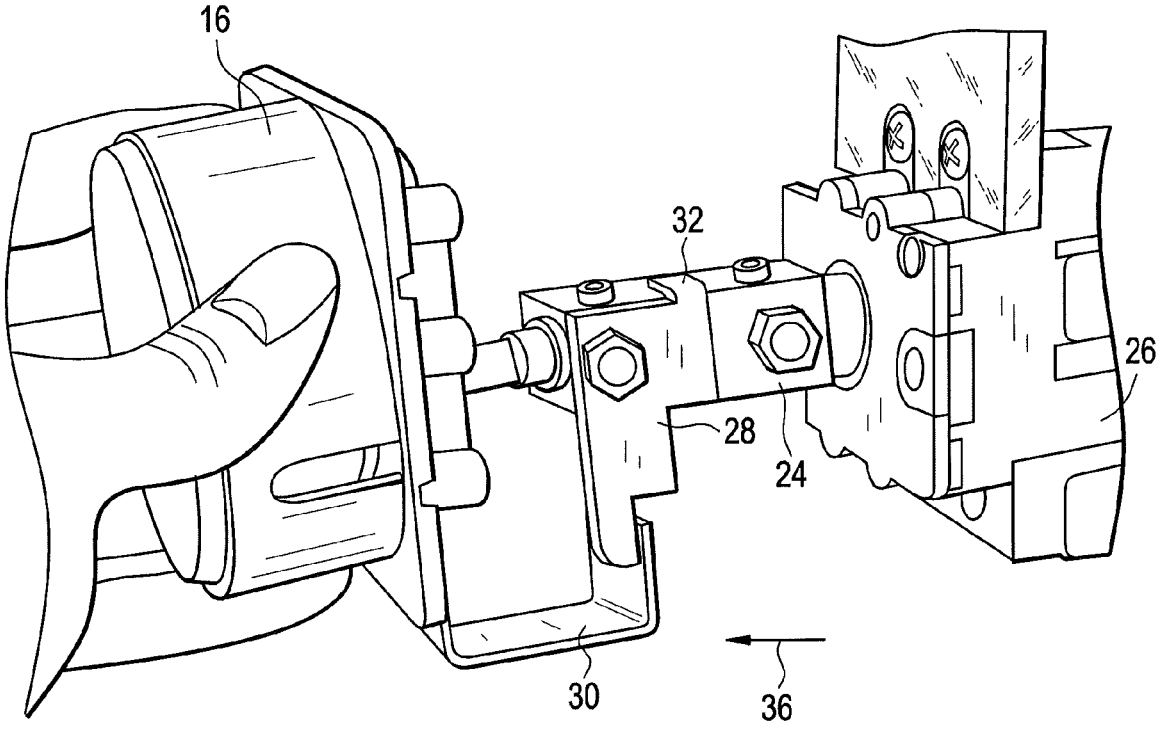
FIG. 7 depicts a perspective view of the disconnect switch of FIG. 5 with the housing removed and moving toward an open position.

Referring to FIG. 7, in the instance that the interlock assembly 22 is in the on position and the door 12 moved in a direction 36 away from the closed position, the bracket 30 also contacts the beam 28. However, in this instance, the mechanical stop 32 prevents the beam from rotating further and the beam 28 engages the bracket 30 to prevent the door from being opened. Accordingly, if the switch assembly 22 is on, the interlocking member 28 will rotate out of the path of the bracket 30 as the door 12 is closed but will not rotate out of the path of the bracket 30 as the door 12 is opened. This again ensures that if the switch assembly 22 is on, the user can close the door 12 but not open it.

Figure 8:
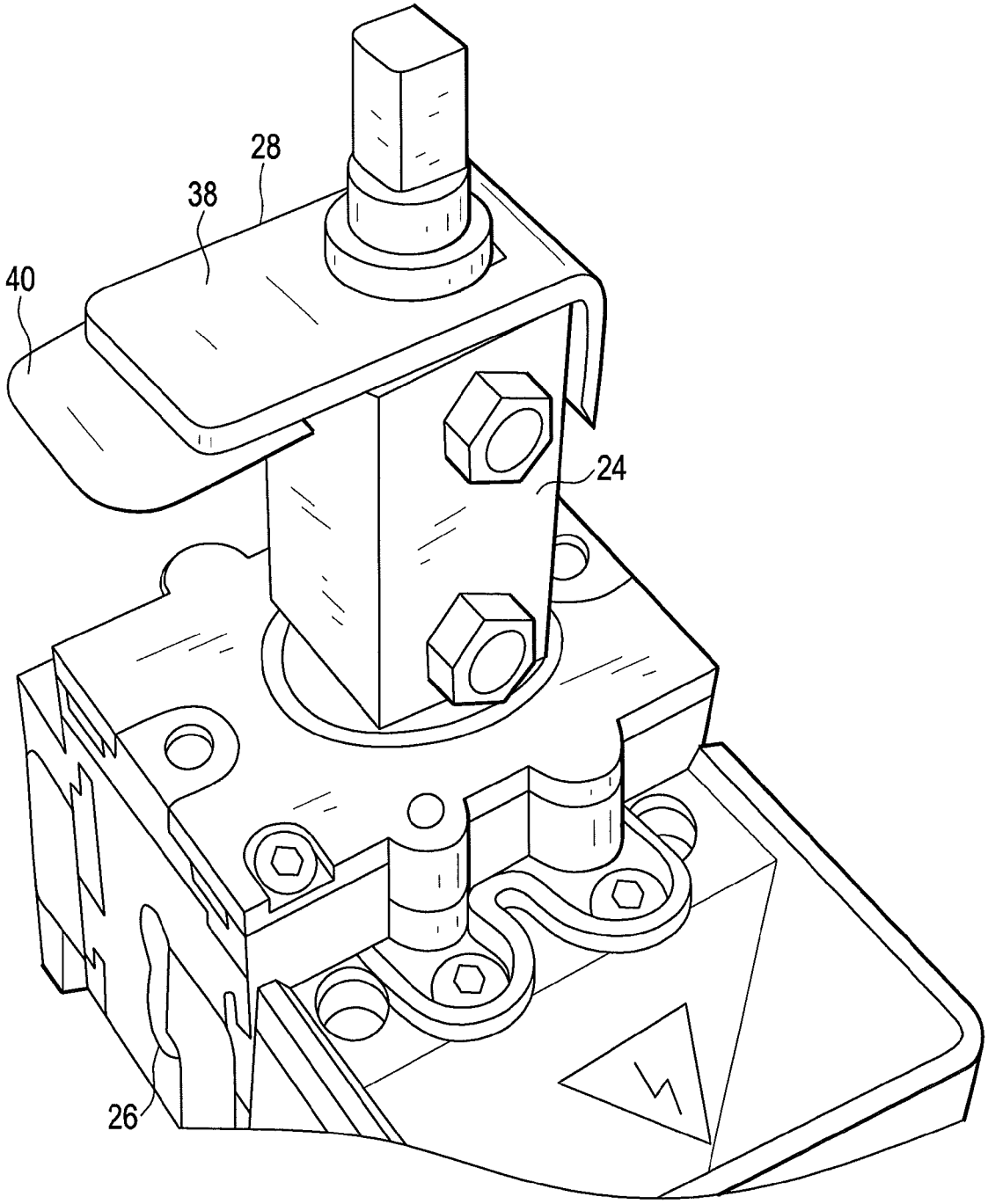
FIG. 8 depicts a perspective view of another embodiment of the disconnect switch of FIG. 1.

Referring to FIG. 8, another embodiment of the interlocking assembly 22 is shown. In this embodiment, the interlocking member 28 includes two overlapping component members 38 and 40. The first component member 38 is a relatively rigid cantilever beam extending from the shaft 28 in a direction orthogonal to the shaft axis of rotation. The second component member 40 is a relatively flexible, resilient member attached to the first component member 38. A portion of the flexible member 40 extends in the orthogonal direction beyond an end of the first member 38, and is configured to bend in a direction toward the closed position and stay rigid in a direction toward the open position. Thus, when the switch 18 is in the on position, the bracket 30 bends the flexible cantilever beam 40 out of the path of the bracket 30 as the door 12 is closed, but if the door is moved from the closed to the open position, the bracket 30 is unable to bend the flexible beam 40 and the door 12 is prevented from opening.

For example, the rigid member 38 is a generally flat, forming surfaces that generally face in a direction that is parallel to the axis of rotation of the shaft 24. The flexible member 40 is also generally flat and is attached to the rigid member 40 in a surface facing the interior of the housing 10.

In one embodiment, the first component member is made of a rigid material such as aluminum. The second component member is made of a flexible, resilient material such as spring steel.

Figure 9:
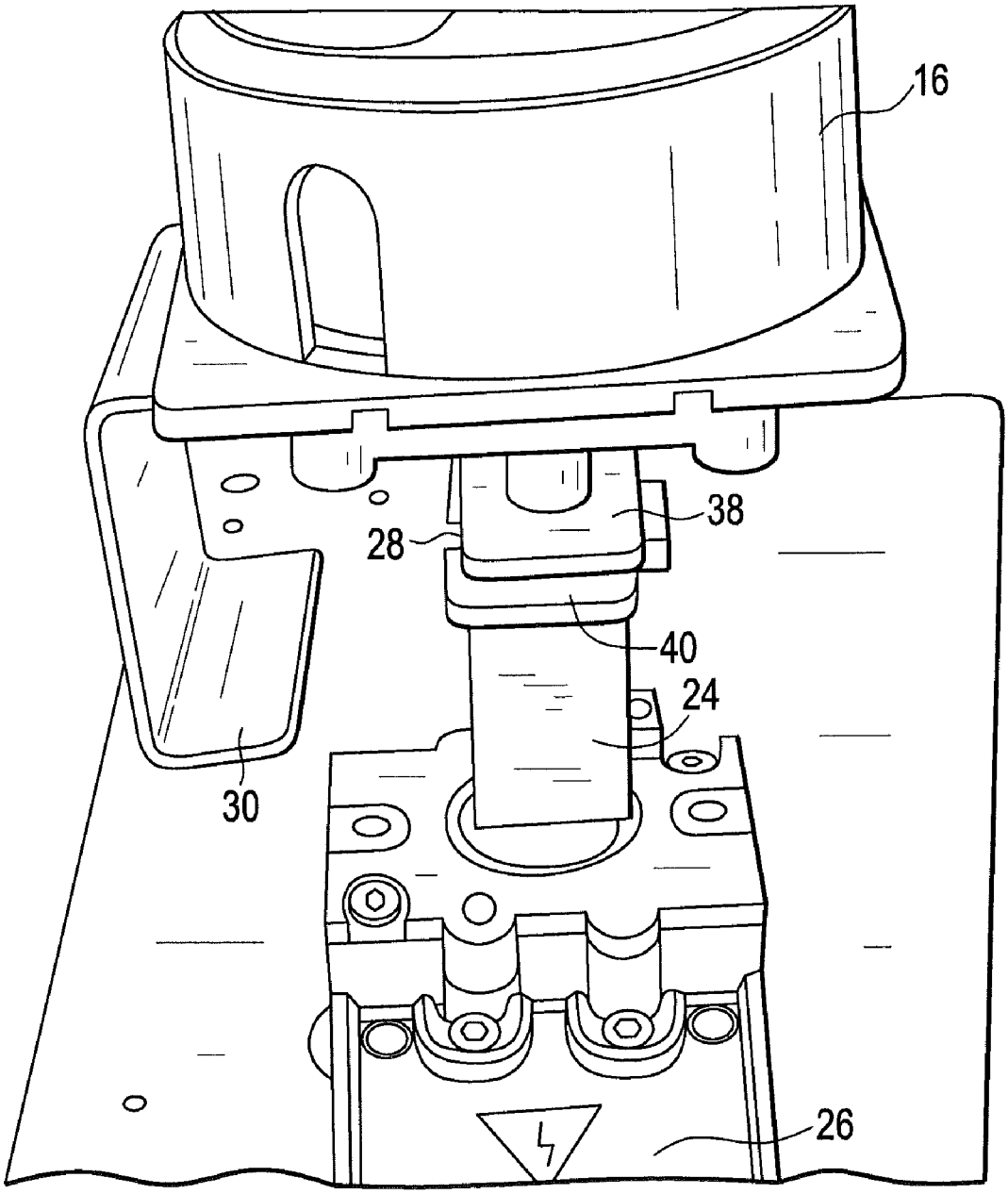
FIG. 9 depicts a perspective view of the disconnect switch of FIG. 8 with the housing removed and in an off position.
Figure 10:
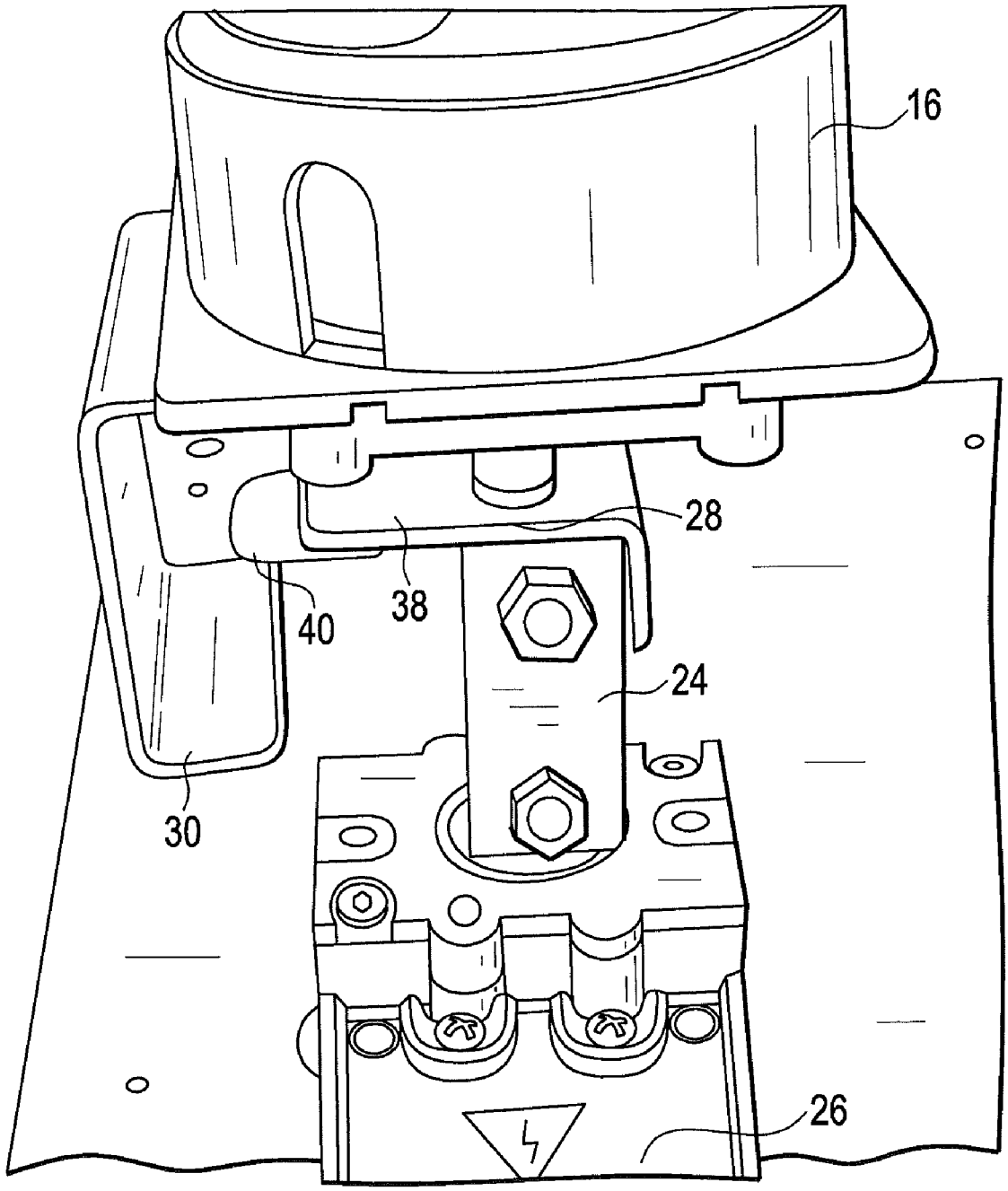
FIG. 10 depicts a perspective view of the disconnect switch of FIG. 8 with the housing removed and in an on position.

Referring to FIG. 9, the interlock assembly 22 is shown in the off position. As shown, the interlocking member 28 is positioned away from a path of the bracket 30, thus allowing the door 12 to be opened and closed without interference. Referring to FIG. 10, when the interlock assembly 22 is in the on position, a portion of the flexible member 40 is in the path of the bracket 30.

Figure 11:
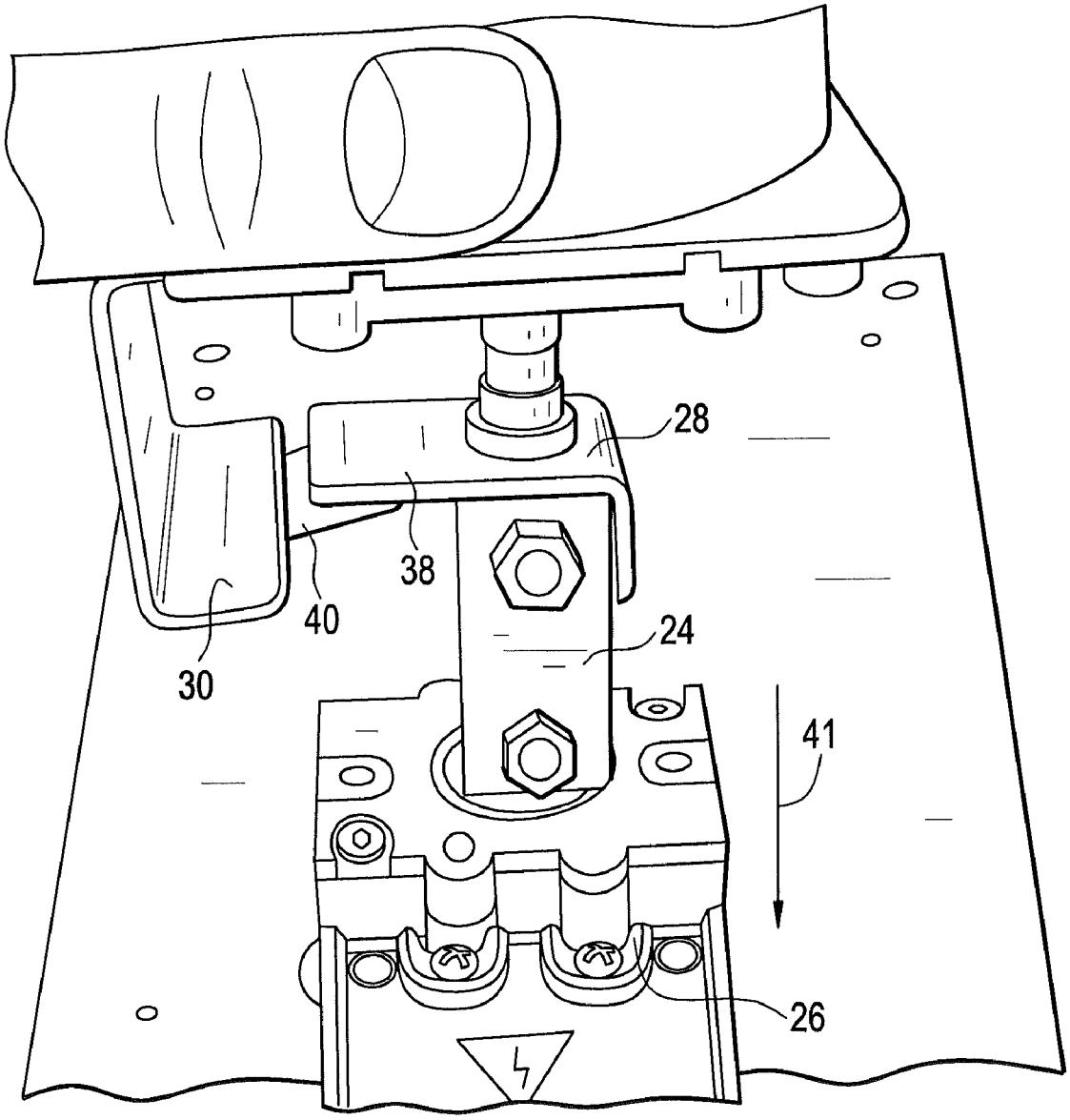
FIG. 11 depicts a perspective view of the disconnect switch of FIG. 10 with the housing removed and moving toward a closed position.

Referring to FIG. 11, if the interlock assembly is in the on position and the door 12 is moved in a direction 41 from the open position to the closed position, the bracket 30 causes the flexible member 40 to bend and allow the door 12 to be closed. For example, the flexible member 40 bends toward the interior of the enclosure 10 and thus allows the bracket 30 to over come any interference introduced by the flexible member 40.

Figure 12:
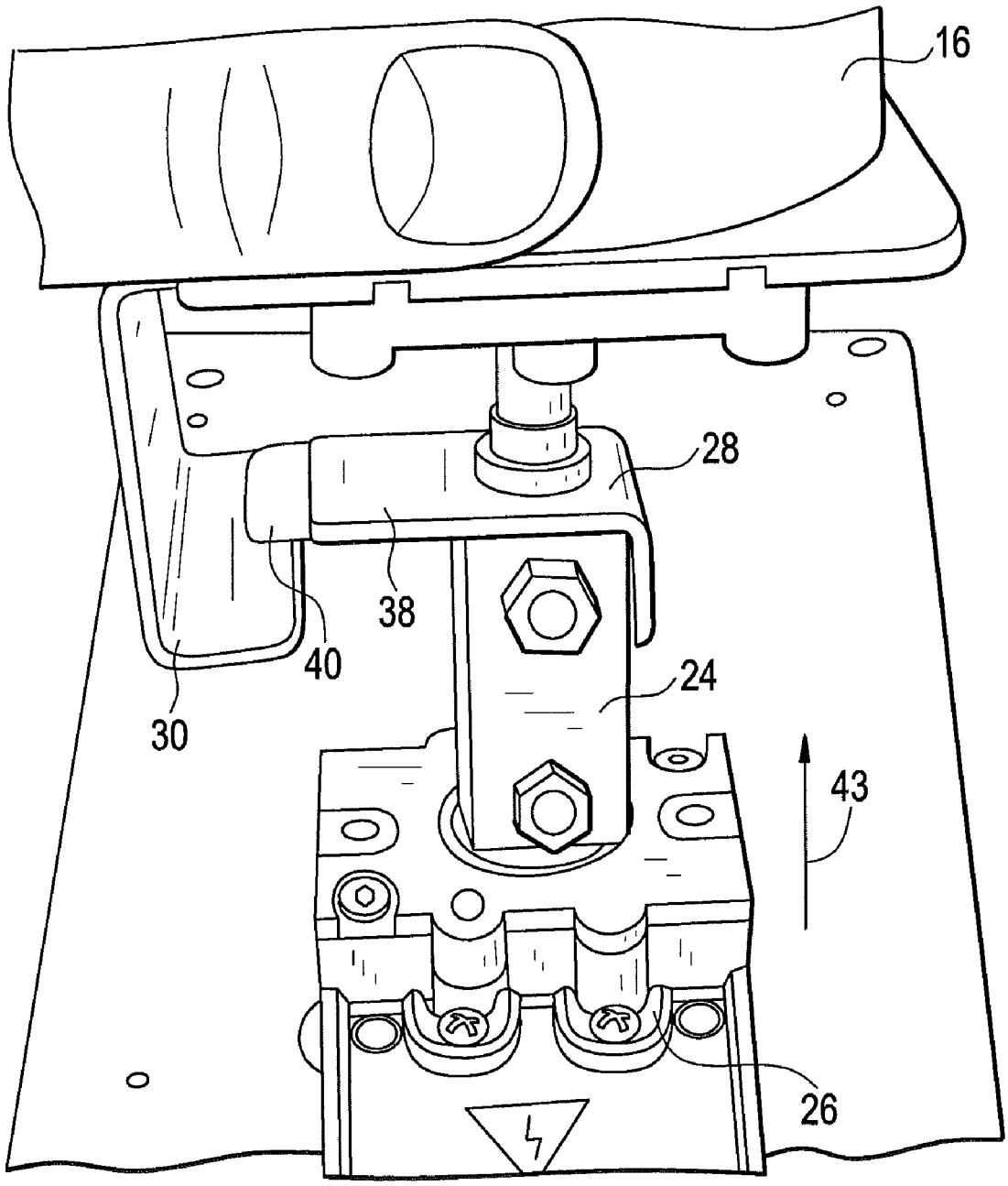
FIG. 12 depicts a perspective view of the disconnect switch of FIG. 10 with the housing removed and moving toward an open position.

Referring to FIG. 12, if the interlock assembly 22 is in the on position and the door 12 is moved in a direction 43 from the closed position toward the open position, the flexible member 40 will not bend and thus the bracket 30 is prevented from further movement. For example, due to the position of the flexible member 40 in the surface of the rigid member 38, the flexible member 40 is prevented from bending toward the exterior by the rigid member 38. A distance "d" is determined between a latch surface of the flexible member 40 and the locking surface of the C-shaped bracket 30. The distance "d" is great enough to allow the interlock assembly 22 to be defeated yet still not allow the door 12 to be opened enough to allow access to live electrical components.

Figure 13:
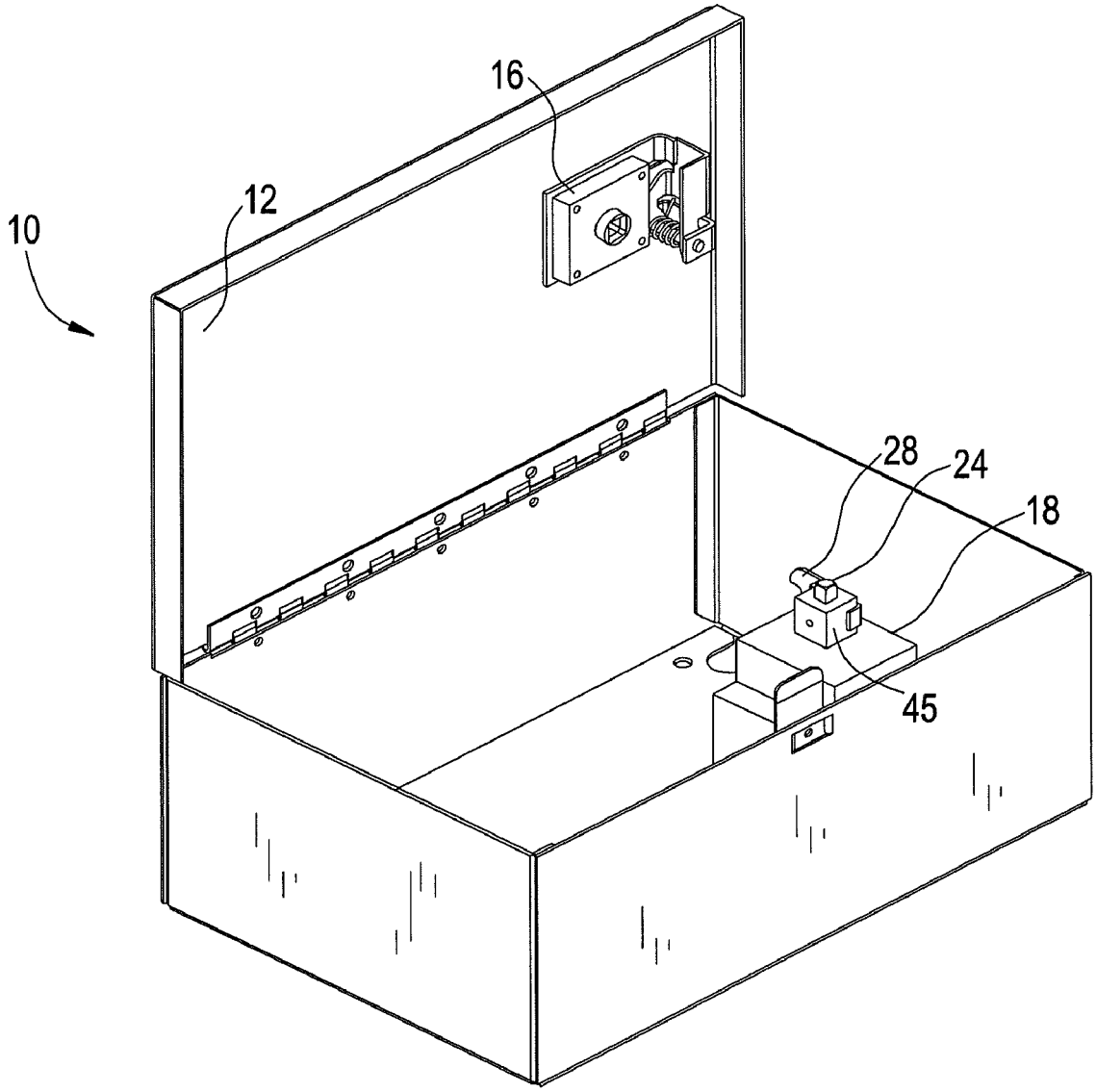
FIG. 13 depicts a perspective view of the enclosure of FIG. 1 including another embodiment of the disconnect switch.
Figure 14:
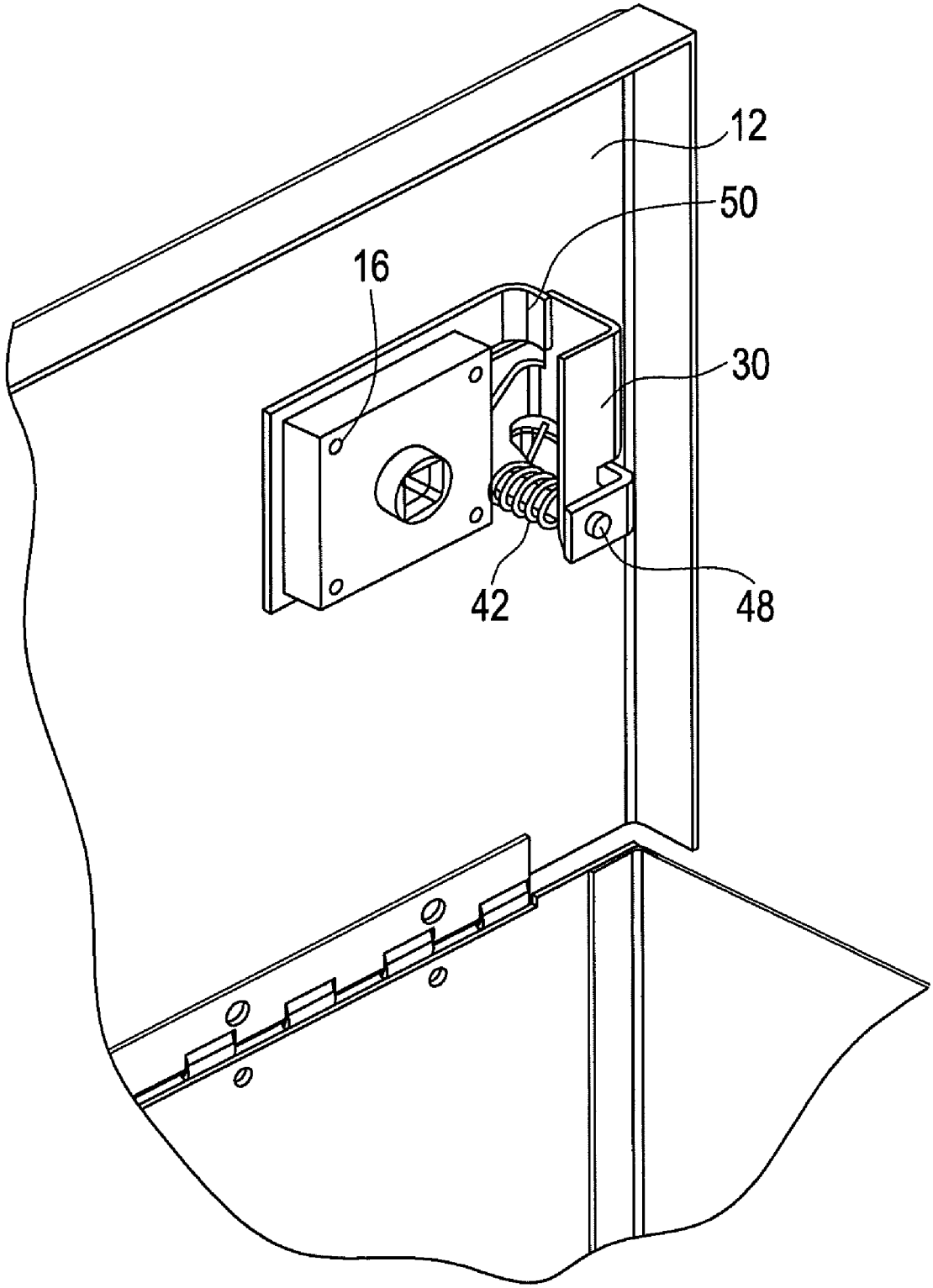
FIG. 14 depicts a magnified perspective view of components of the disconnect switch of FIG. 13 disposed on the housing door.
Figure 15:
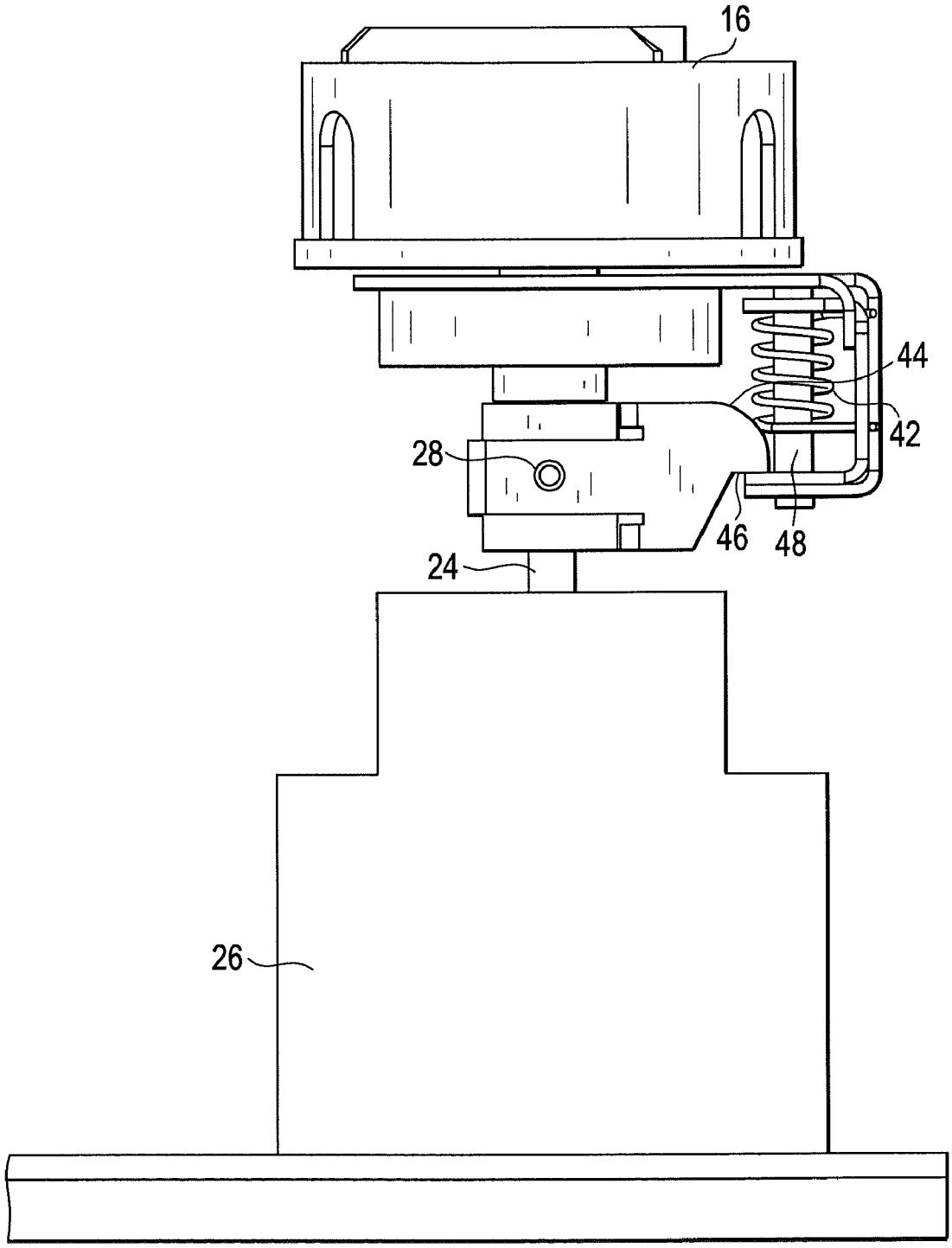
FIG. 15 depicts a magnified perspective view of components of the disconnect switch of FIG. 13 disposed inside the housing.

Referring to FIGS. 13-15, another embodiment of the interlocking assembly 22 is shown. In this embodiment, the interlocking assembly 22 includes the latch 28 attached to the shaft 24 and having a cammed surface, and the bracket 30 is a hinged bracket attached to the inside of the door 12 that includes a biasing device 42 such as a torsion spring. The cammed surface on the latch 28 ensures that if the door 12 is closed while the switch is in the on position, then the latch 28 will force the bracket to hinge away from the latch 28, but if a user attempts to open the door 12 while the switch is in the on position, the latch 28 will not cause the bracket 30 to hinge away from the latch 28. When the switch is in the off position, the latch is rotated away from the path of the bracket 30, allowing the door 12 to be opened or closed without any additional action required by the user. In one embodiment, the shaft 28 is mounted on a spacer block 45 or other structure to control the height and location of the shaft 28.

The shaft 28 includes opposite surfaces 44 and 46. The first surface 44 is a cammed surface generally facing the exterior of the housing 10, and the second surface 46 includes a generally flat latching surface opposite the first surface.

The latching surface 46, when the switching assembly is in the on position, engages the bracket 30 to prevent the door 12 from being moved from the closed position to the open position. When the door 12 is moved from the open position toward the closed position, the cammed surface 44 interferes with the bracket 30 causing the bracket 30 to rotate about a pivot pin 48 or other pivot point and move away from the latch 28. A biasing member such as the torsion spring 42 causes the bracket 30 to move toward a rest position. In one embodiment, the rest position is provided by a mechanical stop 50 such as a stop tab attached to the door 12.

Figure 16:
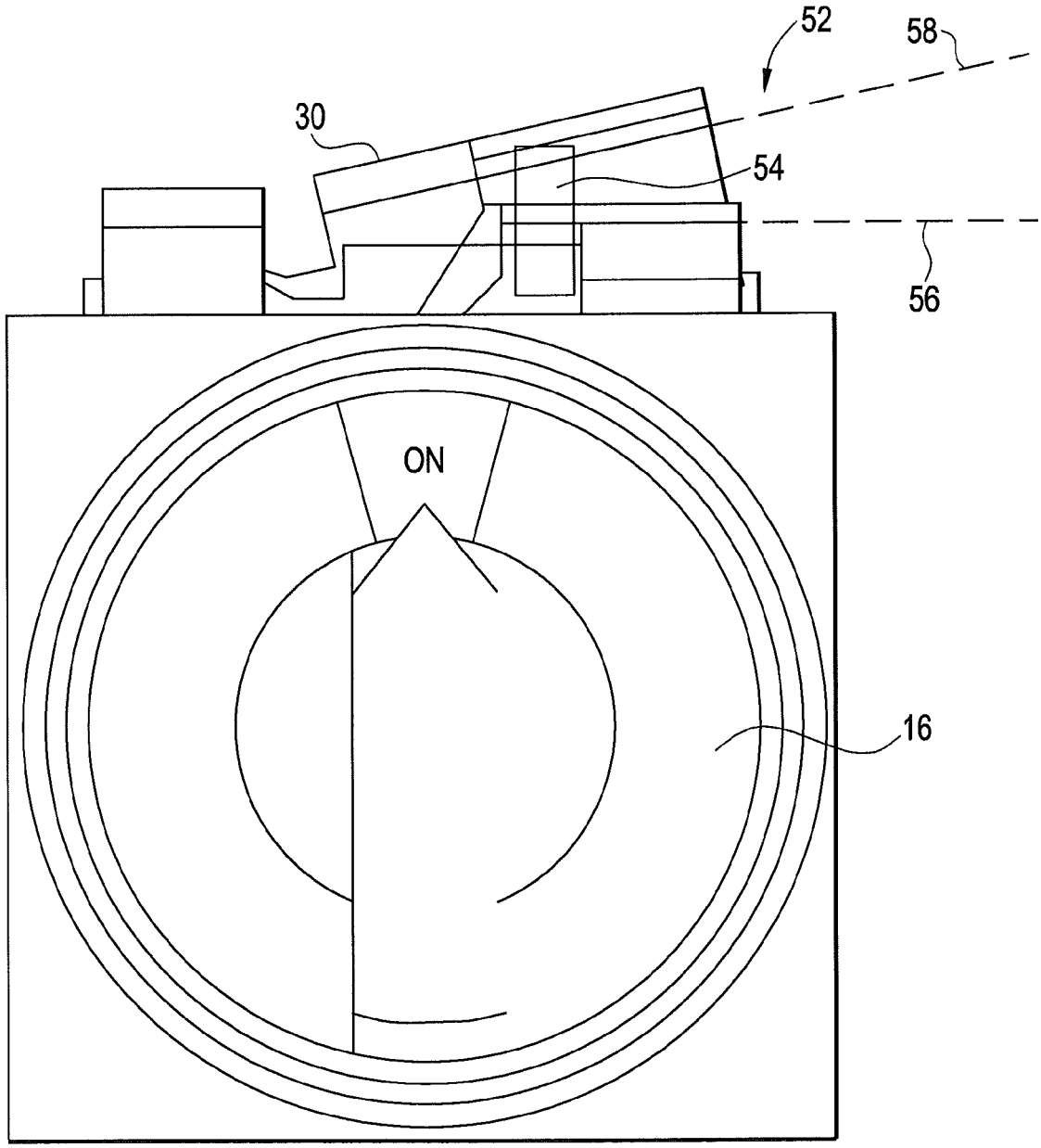
FIG. 16 depicts a front view of a rotary handle of the disconnect switch of FIG. 13.

Referring to FIG. 16, the handle includes a interlock defeating device 52 that includes the bracket 30 attached to the pivot pin 48 and the torsion spring 42, and a defeat slot 54. The defeat slot 54 is an opening in the handle 12 and/or the door 12 that is configured to allow a probe or other device to be inserted into the handle 12. The inserted probe is used to exert a force on the bracket 30 to overcome the torsion spring 42 and rotate the bracket 30 away from the latch 28 when the door is the closed position and the switch assembly 22 is in the on position. In this way, the interlock assembly 22 can be defeated to allow a user to open the door 12 even when the interlock assembly is in the on position. The slot 54 allows the bracket 30 to be rotated between a first position 56, in which the latch 28 and the bracket 30 are disengaged, and a second position 58, in which the latch 28 and the bracket 30 are disengaged.

After the interlocking assembly 22 has been defeated, the door 12 may be closed with an automatic reset device such as the torsion spring 42, which causes the bracket 30 to rotate toward the rest position in which the bracket is held against the lever stop tab 50.

The systems and methods described herein provide numerous advantages over prior art systems. The device and method provide an effective interlock for rotary style handles to enhance user safety. The device and method ensuring that unless a user takes deliberate and specific action to defeat the interlock, such as by affirmatively engaging a defeat mechanism, the user will not be able to open the enclosure unless the disconnect switch is off. This protects the user from gaining access to inside of the electrical enclosure unless the power is disconnected using the disconnect switch or the user takes deliberate action to defeat the interlock. Furthermore, the device and method ensure that the user can close the electrical enclosure door whether the disconnect switch is on or off.

Furthermore, the systems and methods provide a simple and affordable interlock mechanism for use with a rotary handle, in contrast to lever type handles that utilize a lever that rotates up or down around a fixed point at one end of the lever. The systems and methods may be used with a disconnect switch in which the user instead rotates a rotary handle clockwise and counter-clockwise. The systems and methods allow for the use of a door-mounted rotary disconnect switch and therefore leads to a reduction in cost, complexity, and size while also making the product more visually appealing.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the invention if they have structural elements that do not differ from the literal language of the claims, or if they include equivalent structural elements with insubstantial differences from the literal language of the claims.

What is claimed is:

1. An interlock system in combination with an enclosure, the combination comprising:

an enclosure having a base and a door that define an interior, the door having an open position and a closed position;

a rotary handle attached to the door of the enclosure;

a disconnect switch disposed in the interior of the enclosure, the disconnect switch including a shaft extending toward an exterior of the enclosure in a direction toward the door, the handle configured to engage the shaft when the door is in the closed position and rotate the shaft to move the shaft of the disconnect switch between an on position and an off position;

a first interlocking member attached to the door and extending toward an interior of the enclosure; and a second interlocking member attached to the shaft, the second interlocking member being configured to engage and interlock with the first interlocking member when the door is in the closed position and the disconnect switch is in the on position, wherein the second interlocking member comprises a cantilever beam rotatably attached to the shaft and configured to rotate about an axis that is orthogonal to a rotational axis of the shaft.

2. The combination of claim 1, further comprising:

an electrical device disposed within the enclosure;

wherein the disconnect switch is configured to engage the electrical device to electrically connect the electrical device to an electric power source when the disconnect switch is disposed in the on position; and wherein the disconnect switch is configured to disengage the electrical device to electrically disconnect the electrical device from the electric power source when the disconnect switch is disposed in the off position.

3. The combination of claim 2, wherein the electrical device comprises a circuit breaker.

4. The combination of claim 1, wherein the first interlocking member comprises a "C"-shaped bracket.

5. The combination of claim 1, wherein the second interlocking member is configured to rotate about a shaft rotational axis between the on position and the off position, the second interlocking member is disposed at a first location in the on position and a second location in the off position, the first location is intersected by the first interlocking member when the door is moved between the open position and the closed position, and the second location is not intersected by the first interlocking member when the door is moved between the open position and the closed position.

6. The combination of claim 1, wherein the second interlocking member comprises a mechanical stop to prevent rotation of the shaft toward the door.

7. A method of controlling a position of an enclosure, the method comprising:

attaching a rotary handle on a door of the enclosure;

disposing a disconnect switch in an interior of the enclosure, the disconnect switch including a shaft extending toward an exterior of the enclosure, the handle configured to engage the shaft when the door is in the closed position and rotate the shaft to move the shaft of the disconnect switch between an on position and an off position;

attaching a first interlocking member to the door, the first interlocking member extending toward an interior of the enclosure;

attaching a second interlocking member attached to the shaft;

moving the shaft of the disconnect switch between the on position and the off position;

responsive to the disconnect switch being in the on position, engaging the first interlocking member with the second interlocking member to i) prevent the door from being moved from the closed position toward the open position and ii) allow the door to be moved from the open position toward the closed position; and responsive to the disconnect switch being in the off position, engaging the first interlocking member with the second interlocking member to allow the door to be moved between the open position and the closed position, wherein the second interlocking member is a cantilever beam rotatably attached to the shaft and configured to rotate about an axis that is orthogonal to a rotational axis of the shaft.

8. The method of claim 7, wherein the disconnect switch engages an electrical device in the enclosure to electrically connect the device to an electric power source in the on position, and the disconnect switch disengages the device to disconnect the device from the power source in the off position.

9. The method of claim 7, wherein moving the shaft of the disconnect switch includes rotating the shaft and the second interlocking member about a shaft rotational axis between the on position and the off position, the second interlocking member intersects a path of the first interlocking member in the on position, and the second interlocking member is located away from the path in the off position.

10. The method of claim 7, wherein the second interlocking member includes a mechanical stop to prevent rotation of the shaft toward the door.

* * * * *